US012768583B2

(12) United States Patent
Tseng

(10) Patent No.: US 12,768,583 B2
(45) Date of Patent: Oct. 20, 2026

(54) DIRECT-COOLING TUBE AND WATER REFRIGERATING DEVICE OF ATMOSPHERIC WATER GENERATOR

(71) Applicants: Kingtronics Smart Industrial Interconnection Networking(Fujian) Co., Ltd., Xiamen (CN); Kingtronics Smart Industrial (Xiamen) Co., Ltd., Xiamen (CN)

(72) Inventor: Chee Henry Tseng, Xiamen (CN)

(73) Assignees: Kingtronics Smart Industrial Interconnection Networking(Fujian) Co., Ltd., Xiamen (CN); Kingtronics Smart Industrial (Xiamen) Co., Ltd., Xiamen (CN)

( * ) Notice: Subject to any disclaimer, the term of this patent is extended or adjusted under 35 U.S.C. 154(b) by 159 days.

(21) Appl. No.: 18/589,395

(22) Filed: Feb. 27, 2024

(65) Prior Publication Data

US 2025/0216145 A1 Jul. 3, 2025

(30) Foreign Application Priority Data

Dec. 28, 2023 (CN) ..... 202311843951.0

(51) Int. Cl.
*F25D 21/04* (2006.01)

(52) U.S. Cl.
CPC ..... *F25D 21/04* (2013.01)

(58) Field of Classification Search
CPC ... F25D 21/04; F28D 7/12; E03B 3/28; F25B 41/40; F25B 41/31
USPC ..... 62/282; 165/177, 184
See application file for complete search history.

(56) References Cited

U.S. PATENT DOCUMENTS 2,044,951 A * 6/1936 Munters ..... F25B 17/00 62/480
2,530,648 A * 11/1950 Cahenzli, Jr. ..... F25B 43/006 165/145
3,545,063 A * 12/1970 Orville ..... F25B 39/02 29/890.07
3,802,499 A * 4/1974 Garcea ..... F28D 7/10 165/DIG. 407
4,321,963 A * 3/1982 Bowden ..... F28D 7/024 165/70
4,559,999 A * 12/1985 Servas ..... A61M 1/3623 165/184
5,056,593 A * 10/1991 Hull ..... F28B 1/02 165/111
5,149,446 A * 9/1992 Reidy ..... E03B 3/28 62/93

(Continued)

*Primary Examiner* — Eric S Ruppert
*Assistant Examiner* — Kirstin U Oswald

(57) ABSTRACT

The present disclosure provides a direct-cooling tube and a water refrigerating device of an atmospheric water generator, the water refrigerating device includes a direct-cooling tube, the direct-cooling tube includes an inner tube provided with a refrigerant input joint and a refrigerant output joint and a hollow outer tube provided with a water input joint and a water output joint; the refrigerant input joint and the refrigerant output joint of the inner tube both communicate with the inner tube and both extend out of the outer tube; an outer peripheral wall of the inner tube is provided with a cooling fin. Using the direct-cooling tube to refrigerate the water can make the water temperature reach the effect of instant-cooling, thereby further saving energy.

7 Claims, 9 Drawing Sheets

(56) References Cited

U.S. PATENT DOCUMENTS 5,203,989 A * 4/1993 Reidy ..... C02F 1/18 62/93
5,259,203 A * 11/1993 Engel ..... F24F 3/1405 62/291
5,517,829 A * 5/1996 Michael ..... E03B 3/28 210/764
5,553,459 A * 9/1996 Harrison ..... E03B 3/28 62/93
6,029,461 A * 2/2000 Zakryk ..... B01D 53/265 62/93
6,058,718 A * 5/2000 Forsberg ..... E03B 3/28 62/150
6,755,037 B2 * 6/2004 Engel ..... E03B 3/28 62/177
7,373,787 B2 * 5/2008 Forsberg ..... E03B 3/28 62/93
7,597,136 B2 * 10/2009 Kite ..... F28D 7/024 165/184
9,091,487 B2 * 7/2015 Byon ..... F28D 7/14
12,173,483 B1 * 12/2024 Haslem ..... A61L 9/20
2002/0189273 A1 * 12/2002 Tani ..... B01D 5/0039 62/93
2006/0201180 A1 * 9/2006 Kidwell ..... F24T 10/17 165/45
2007/0023164 A1 * 2/2007 Kidwell ..... F28F 13/12 165/45
2007/0295021 A1 * 12/2007 Tyls ..... E03B 3/28 62/317
2009/0077992 A1 * 3/2009 Anderson ..... C02F 1/041 62/291
2010/0083676 A1 * 4/2010 Merritt ..... E03B 3/28 62/93
2013/0047655 A1 * 2/2013 White ..... F24F 5/001 62/291
2013/0220906 A1 * 8/2013 Stenhouse ..... E03B 3/28 165/80.1
2014/0216699 A1 * 8/2014 Lee ..... F28D 7/12 165/163
2018/0171603 A1 * 6/2018 Di Benedetti ..... B01D 5/0003
2019/0031546 A1 * 1/2019 Hollingsworth ..... C02F 9/00
2020/0038776 A1 * 2/2020 Van de Mortel .... B01D 5/0006

* cited by examiner

DIRECT-COOLING TUBE AND WATER REFRIGERATING DEVICE OF ATMOSPHERIC WATER GENERATOR

CROSS REFERENCE TO RELATED APPLICATIONS

The present application claims the benefit of Chinese Patent Application No. 202311843951.0 filed on Dec. 28, 2023, the contents of which are incorporated herein by reference in their entirety.

TECHNICAL FIELD

The present disclosure relates to the technical field of atmospheric water generation, and in particular to a direct-cooling tube and a water refrigerating device for an atmospheric water generator.

BACKGROUND

Based on the refrigerant compression, condensation and evaporation refrigeration principle of the compressor, the atmospheric water generator makes the liquid refrigerant undergo a gasification phase change in the evaporator tube to absorb heat, so that the water vapor in the air is condensed into water, and forms a water source of the atmospheric water generator by collecting the water.

In the related art, the atmospheric water generator is generally provided with a freezing tank for refrigerating water using an independent refrigerating device including a compressor and a condenser, and the water in the freezing tank is continuously refrigerated to continuously maintain a low temperature of the cold water, which results in large energy consumption, many components and high cost.

SUMMARY

The present disclosure aims to solve one of the technical problems in the above-mentioned technology at least to some extent. Therefore, an objective of the present disclosure is to provide a water refrigerating device for an atmospheric water generator, and the water refrigerating device formed by the direct-cooling tube can realize refrigeration on demand, thus saving energy.

To achieve the above objective, an embodiment of the present disclosure proposes a water refrigerating device of an atmospheric water generator, including: a direct-cooling tube;

the direct-cooling tube is provided with an inner tube (a water container) and an outer tube (an instant-cooling evaporation tube);

two ends of the outer tube are a water input joint and a water output joint, water to be cooled flows in from one end and flows out from the other end, and the water in the outer tube submerges an outer wall of the inner tube;

the inner tube is arranged inside the outer tube, two ends of the inner tube are provided with a refrigerant input joint and a refrigerant output joint of the inner tube, and a refrigerant is input from one end of the inner tube, evaporates inside the inner tube to absorb heat, and cools water flowing in the outer tube; and an outer peripheral wall of the inner tube is provided with a cooling fin adapted to contact the flow of water in the outer tube, thereby increasing the contact area of the inner tube with the water and improving the refrigeration efficiency.

Optionally, the cooling fin is formed in an Archimedean spiral type and wound around the outer peripheral wall of the inner tube, so that it can be better used to increase the contact area of the inner tube with water to improve the refrigeration efficiency.

Optionally, an overall length and structure of the direct-cooling tube are determined according to a required refrigeration capacity, a refrigeration capacity and an installation manner. In order to improve the refrigeration capacity and the compact installation of the direct-cooling tube, the direct-cooling tube adopts a tube installation structure of a plurality of sections of tube bodies parallel to each other, and the adjacent tube bodies communicate with each other through a circuitous portion.

Optionally, the water refrigerating device further includes a water storage tank, a cold water pump, a cold water circulating valve and a cold water outlet valve.

The direct-cooling tube is disposed between the cold water pump and the cold water outlet valve, and the cold water circulating valve (see FIG. 7). In order to save energy, when cold water is to be output, the direct-cooling tube operates, the cold water pump pumps water from the water storage tank through an outlet valve of the water storage tank into the direct-cooling tube, the direct-cooling tube quickly reduces the temperature of the water to a desired temperature (e.g., 3-4° C.), and the cold water is output from the cold water outlet valve.

Under the action of the cold water pump, through the cold water pump, the direct-cooling tube, the cold water circulating valve, circulating flow of cold water is achieved. In the stand-by state, or in the case where no cold water is used outside, the direct-cooling tube works intermittently, and the cold water is circulated back into the cold water pump through the cold water circulating valve, thus ensuring that the water in the direct-cooling tube remains at a temperature of 3-4° C., and further saving energy.

Further, the atmospheric water generator includes a condenser and a compressor, and the inner tube of the direct-cooling tube communicates with the condenser and the compressor to supply and circulate the refrigerant for cooling.

Specifically, the atmospheric water generator further includes a water-generating evaporator, a water-generating expansion valve and an instant-cooling expansion valve, an output end of the condenser is connected with the water-generating expansion valve and the instant-cooling expansion valve, an input end of the condenser is connected with the compressor, the water-generating expansion valve communicates with the water-generating evaporator, the instant-cooling expansion valve communicates with the refrigerant input joint of the inner tube, and the water-generating evaporator and the refrigerant output joint of the inner tube both communicate with the compressor. Such that the direct-cooling tube shares one compressor and one condenser with the water-generating evaporator, by means of two expansion valves (the water-generating expansion valve, and the instant-cooling expansion valve), the direct-cooling tube and the water-generating evaporator are connected respectively. Depending on the demand for water generation and the demand for cold water, under control of a control device, the water-generating expansion valve and the direct-cooling expansion valve are automatically adjusted, respectively, to achieve condensation water generation and cold water refrigeration functions, thus reducing the components of the whole atmospheric water generation system, and reducing the cost of the whole system. Besides, the structure is compact, the equipment volume is greatly reduced, and the system is more practical. The respective units cooperate with each other to reduce energy consumption and cost.

Additional aspects and advantages of the disclosure will be set forth in part in the description which follows, and in part will be obvious from the description, or may be learned by practice of the disclosure.

Figure 1:
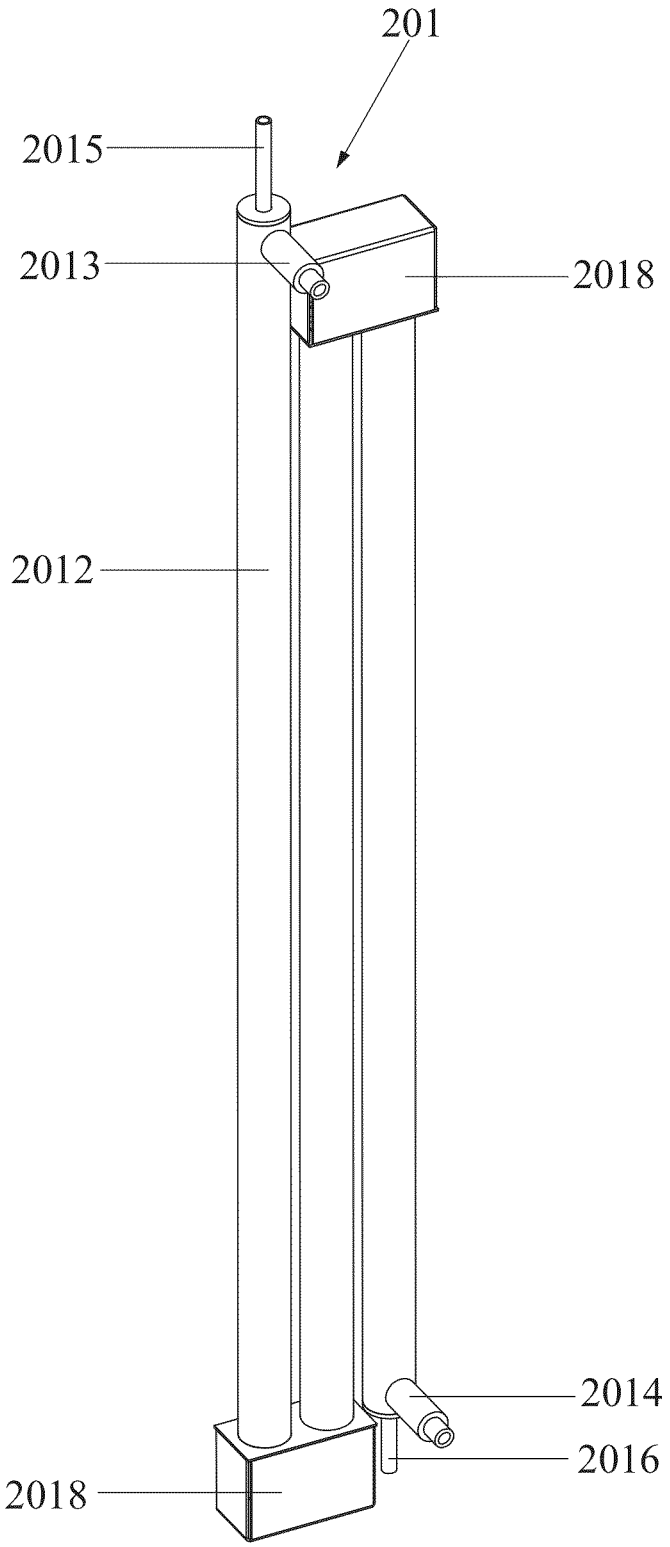
FIG. 1 is a structural schematic diagram of a direct-cooling tube according to an embodiment of the present disclosure.
Figure 2:
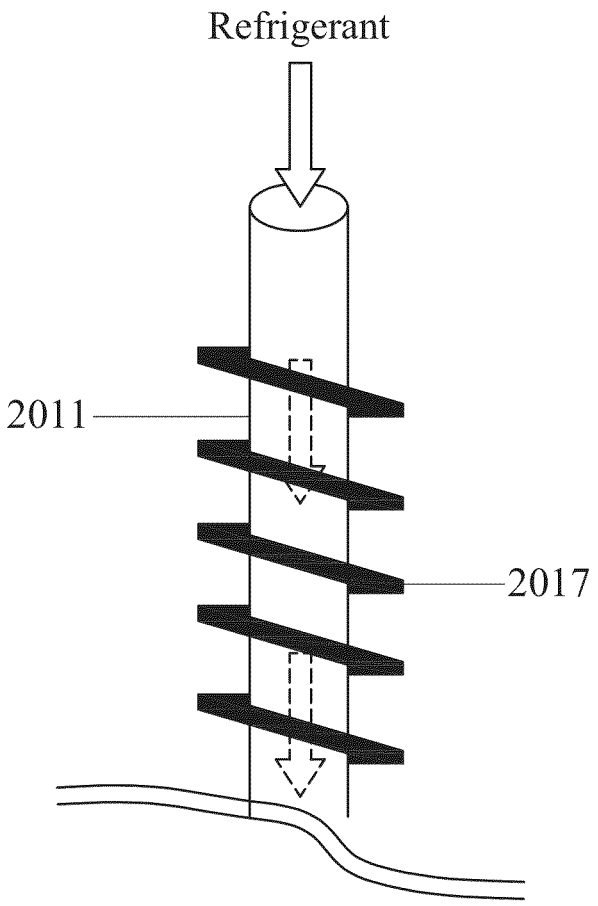
FIG. 2 is a schematic diagram of an inner tube of a direct-cooling tube according to an embodiment of the present disclosure.
Figure 3:
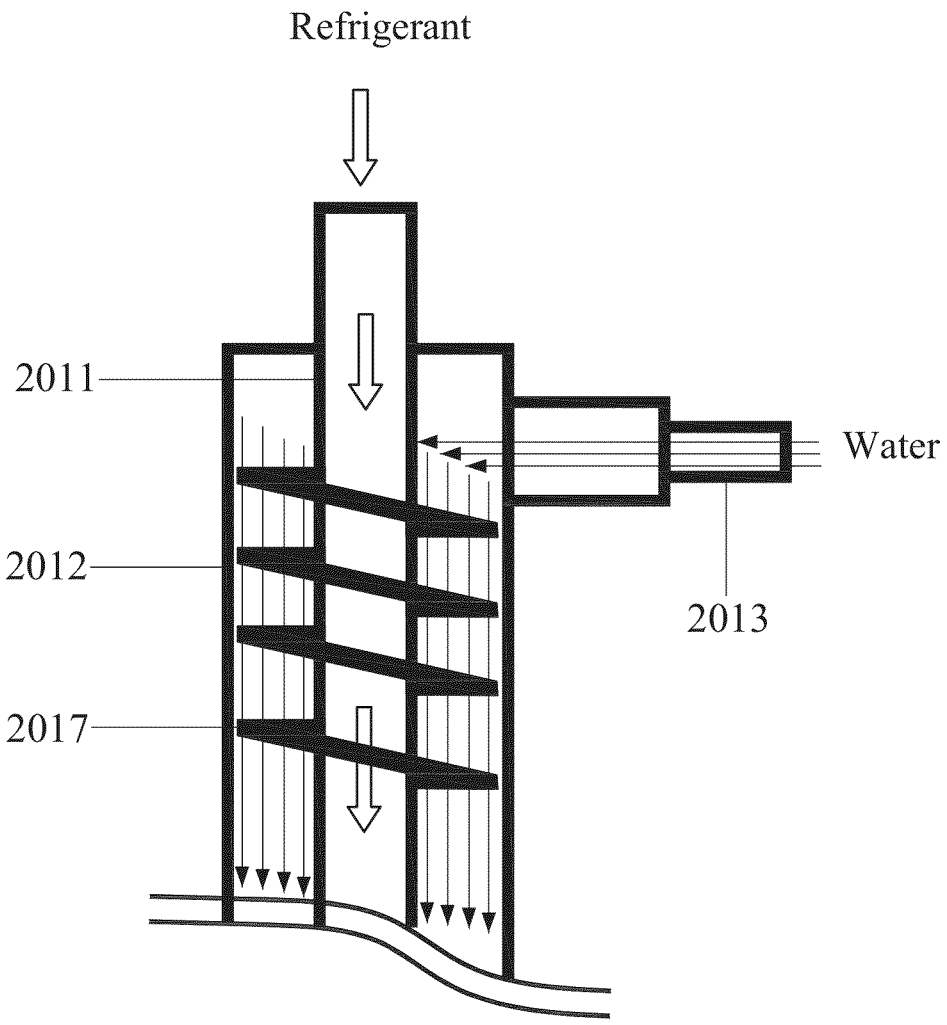
FIG. 3 is a schematic diagram of flow directions of water and refrigerant of a direct-cooling tube according to an embodiment of the present disclosure.
Figure 4:
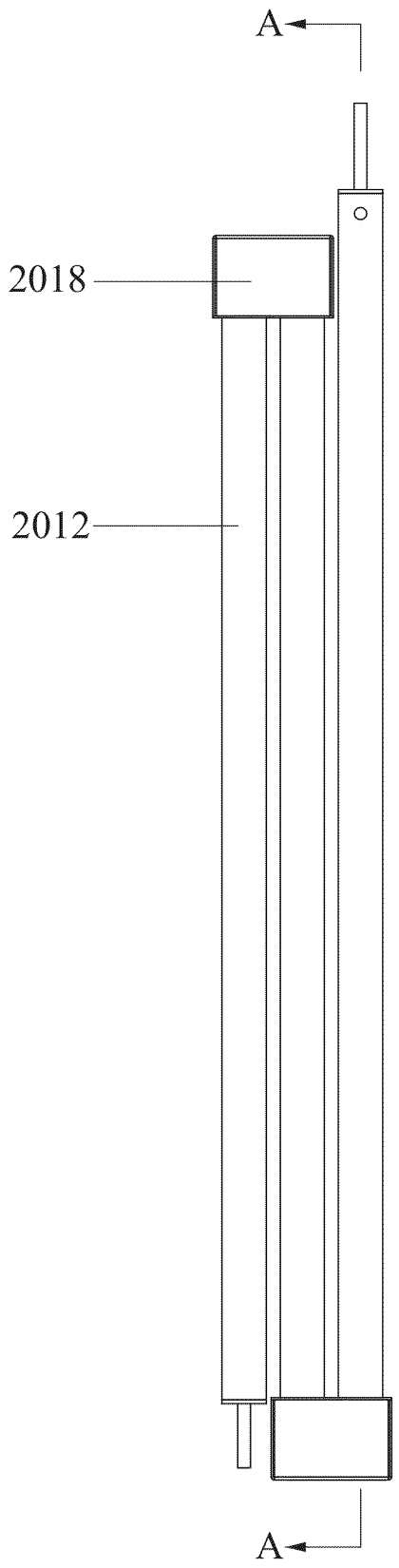
FIG. 4 is a front diagram of a direct-cooling tube according to an embodiment of the present disclosure.
Figure 5:
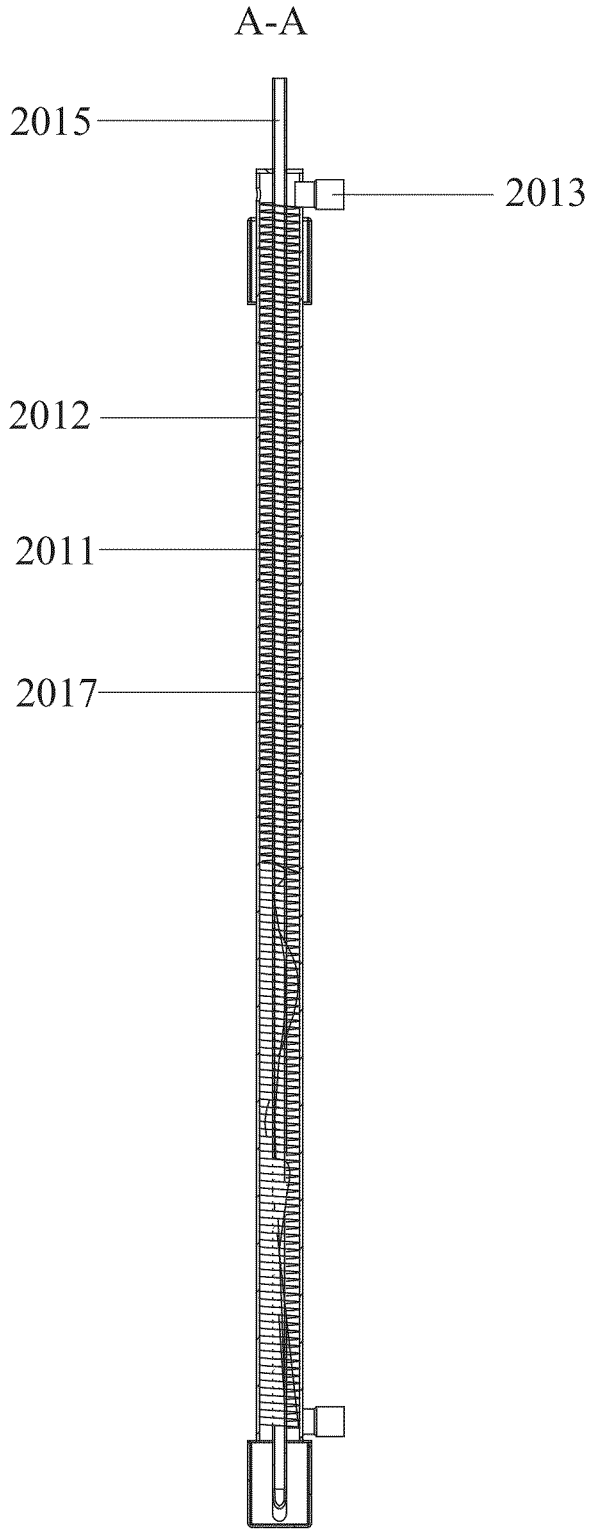
FIG. 5 is a cross-sectional diagram A-A of a direct-cooling tube according to an embodiment of the present disclosure.
Figure 6:
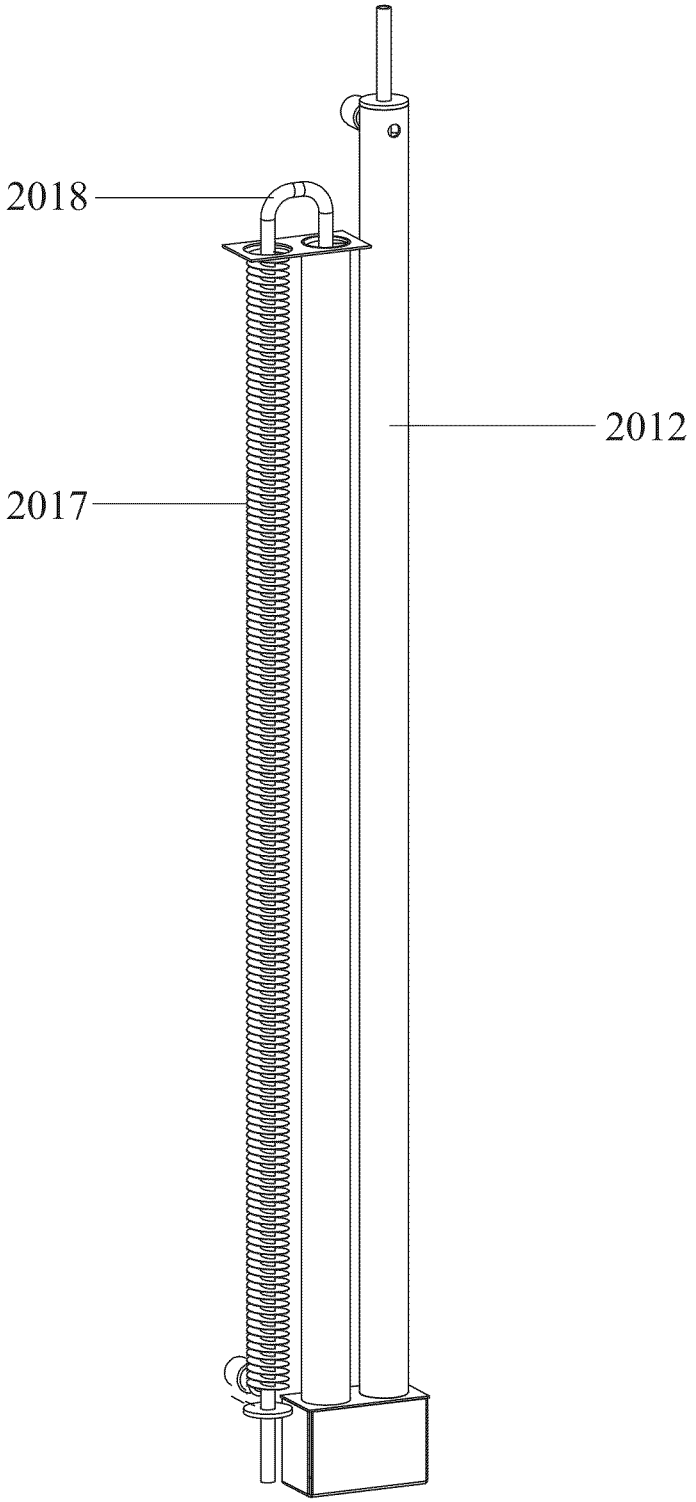
FIG. 6 is an internal schematic diagram of a direct-cooling tube according to an embodiment of the present disclosure.

DESCRIPTION OF REFERENCE NUMERALS atmospheric water generation device 10, water-generating evaporator 101, condenser 102, compressor 103;

water refrigerating device 20, direct-cooling tube 201, inner tube 2011, outer tube 2012, water input joint 2013, water output joint 2014, refrigerant input joint 2015, refrigerant output joint 2016, cooling fin 2017, circuitous portion 2018, water storage tank 202, cold water pump 203;

pipeline 30;

expansion valve 40.

DETAILED DESCRIPTION

Reference will now be made in detail to embodiments of the present disclosure, examples of which are illustrated in the accompanying drawings, wherein the same or similar reference numerals refer to the same or similar elements or elements having the same or similar function throughout. The embodiments described below by referring to the accompanying drawings are exemplary, intended to be used for explaining the present disclosure, and are not to be understood as limiting the present disclosure.

In order to better understand the above technical solutions, exemplary embodiments of the present disclosure will be described in more detail below with reference to the accompanying drawings. While exemplary embodiments of the disclosure are illustrated in the accompanying drawings, it should be understood that the disclosure may be embodied in various forms and should not be limited by the embodiments set forth herein. Rather, these embodiments are provided so that the present disclosure will be more fully understood, and will fully convey the scope of the disclosure to those skilled in the art.

Hereinafter, a water refrigerating device of an atmospheric water generator and an atmospheric water generation device according to the present disclosure will be described in detail with reference to FIGS. 1-9.

<Atmospheric Water Generation Device>

Figure 8:
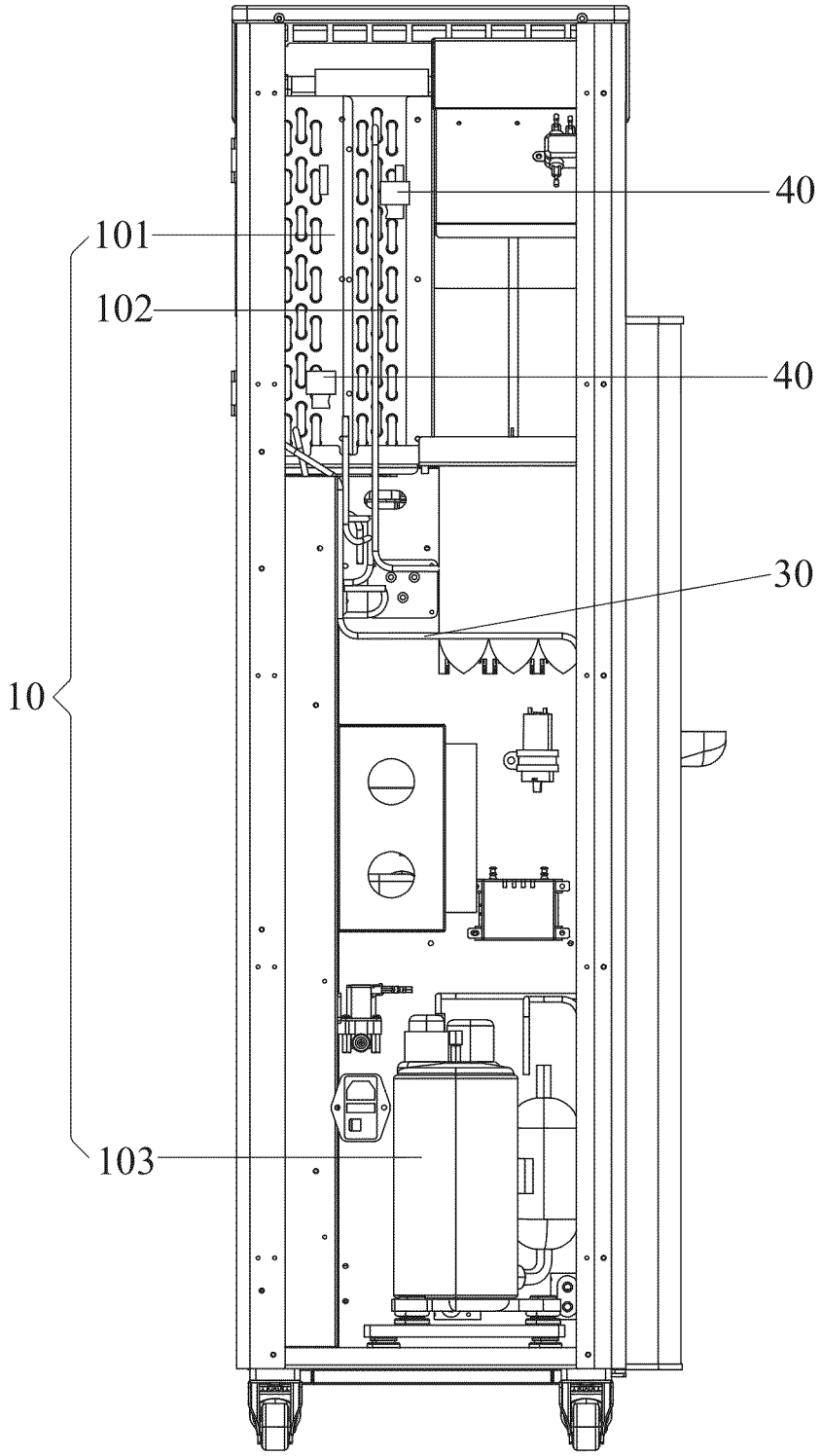
FIG. 8 is a schematic diagram of an internal structure of an atmospheric water generator according to an embodiment of the present disclosure from a first perspective.
Figure 9:
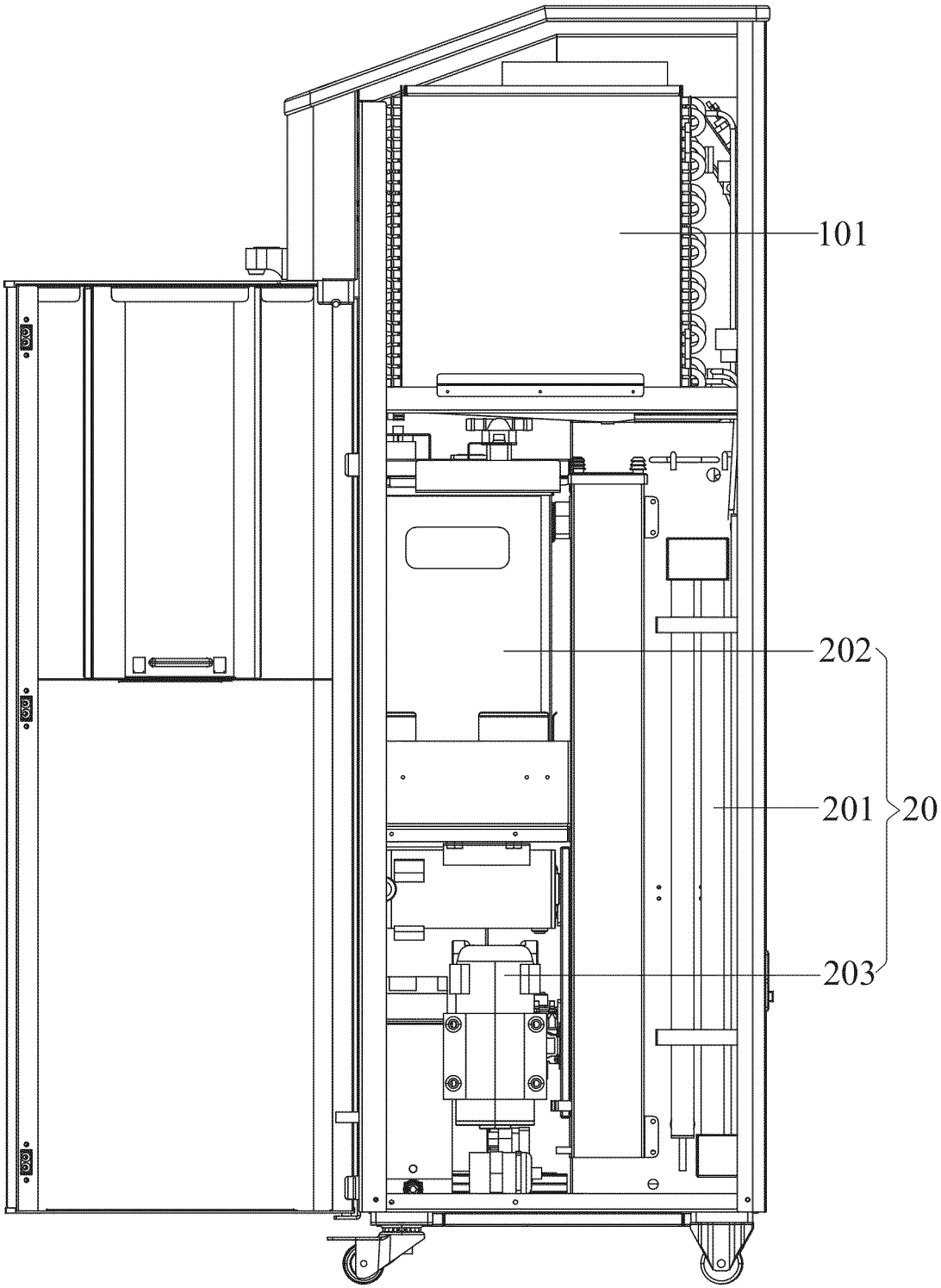
FIG. 9 is a schematic diagram of an internal structure of an atmospheric water generator according to an embodiment of the present disclosure from a second perspective.

Referring to FIGS. 8 and 9, for the atmospheric water generation device 10, the atmospheric water generation device 10 is provided with a water-generating evaporator 101, a condenser 102 connected with the water-generating evaporator 101, and a compressor 103 connected with the water-generating evaporator 101 and the condenser 102 to supply and circulate refrigerant for cooling.

In the atmospheric water generation device 10, the compressor 103 and the condenser 102 operate in such a manner that the refrigerant in the water-generating evaporator 101 or the direct-cooling tube 201 absorbs heat and becomes a gas, is compressed by the compressor 103 into a gas having a high pressure and a high temperature, and is cooled by the condenser 102 into the refrigerant.

The refrigerant cooled by the condenser 102 may be delivered to the water-generating evaporator 101 through a pipeline 30 in which an expansion valve 40 may be provided. In this way, the refrigerant achieves a continuous refrigeration effect in the water-generating evaporator 101.

<Direct-Cooling Tube>

Referring to FIGS. 1-6, a water refrigerating device 20 of an atmospheric water generator according to an embodiment of the present disclosure includes a direct-cooling tube 201.

Specifically, the direct-cooling tube 201 includes an inner tube 2011 and an outer tube 2012.

The outer tube 2012 is hollow inside, the outer tube 2012 is provided with a water input joint 2013 and a water output joint 2014, the water input joint 2013 and the water output joint 2014 communicate with the inside of the outer tube 2012 to pass water inside the outer tube 2012; that is, the outer tube 2012 is a water container provided with water input and output joints on the two ends, and water to be cooled flows in from the water input joint 2013 and out from the water output joint 2014.

The inner tube 2011 is arranged within the outer tube 2012, the inner tube 2011 is provided with a refrigerant input joint 2015 and a refrigerant output joint 2016, the refrigerant input joint 2015 and the refrigerant output joint 2016 both communicate with the inner tube 2011 and both extend out of the outer tube 2012, such that the refrigerant flows in from the refrigerant input joint 2015 and out from the refrigerant output joint 2016 to cool the water flowing in the outer tube 2012, the water in the outer tube 2012 submerges an outer wall of the inner tube 2011; that is, the inner tube 2011 is an instant-cooling evaporation tube, which is disposed inside the outer tube 2012, the inner tube 2011 is provided at both ends with refrigerant input and output joints of the instant-cooling evaporation tube, the refrigerant is input from the refrigerant input joint 2015, and evaporates inside the inner tube 2011 to absorb heat, and cools the water flowing in the outer tube 2012 with the side wall of the inner tube 2011.

In addition, an outer peripheral wall of the inner tube 2011 is provided with a cooling fin 2017 adapted to be in contact with the flow of water in the outer tube 2012. This can increase the contact area of the inner tube 2011 with water, improving the refrigeration efficiency.

With regard to the specific structure of the cooling fin 2017, the cooling fin 2017 is formed in an Archimedean spiral type and wound on the outer peripheral wall of the inner tube 2011, and thus the cooling fin can be better used to increase the contact area of the inner tube 2011 with water, improving the refrigeration efficiency.

Further, end faces of both ends of the cooling fin 2017 in the width direction of the inner tube 2011 are close to or contact an inner peripheral wall of the outer tube 2012. This design ensures that the water inside the outer tube 2012 is in sufficient contact with the cooling fin 2017 and the side wall of the inner tube 2011, improving the refrigeration efficiency.

Thus, in the atmospheric water generator, the direct-cooling tube 201 is used to refrigerate water, so that the water temperature can achieve the effect of instant cooling, and the rapid cooling function of the water can be realized without continuously maintaining the low temperature of the cold water, thus reducing the energy consumption. Furthermore, the direct-cooling tube 201 works with a pump, a circulating valve, and the like, on-demand refrigeration is possible, thereby further saving energy.

An overall length and structure of the direct-cooling tube 201 are determined according to a required refrigeration capacity, a refrigeration capacity and an installation manner. In order to improve the refrigeration capacity and the compact installation of the direct-cooling tube, the direct-cooling tube adopts a tube installation structure of a plurality of sections of tube bodies parallel to each other, and the adjacent tube bodies communicate with each other through a circuitous portion 2018. It will be appreciated that in the circuitous portion 2018, adjacent inner tube bodies communicate with each other through a U-shaped tube and adjacent outer tube bodies communicate with each other through a square-shaped cavity.

Further, the water input joint 2013 and the water output joint 2014 are vertically disposed at an angle of 90° on the outer tube 2012, so that the water input joint 2013, the water output joint 2014, the refrigerant input joint 2015, and the refrigerant output joint 2016 can be reasonably positioned on the outer tube 2012.

<Water Refrigerating Device>

Figure 7:
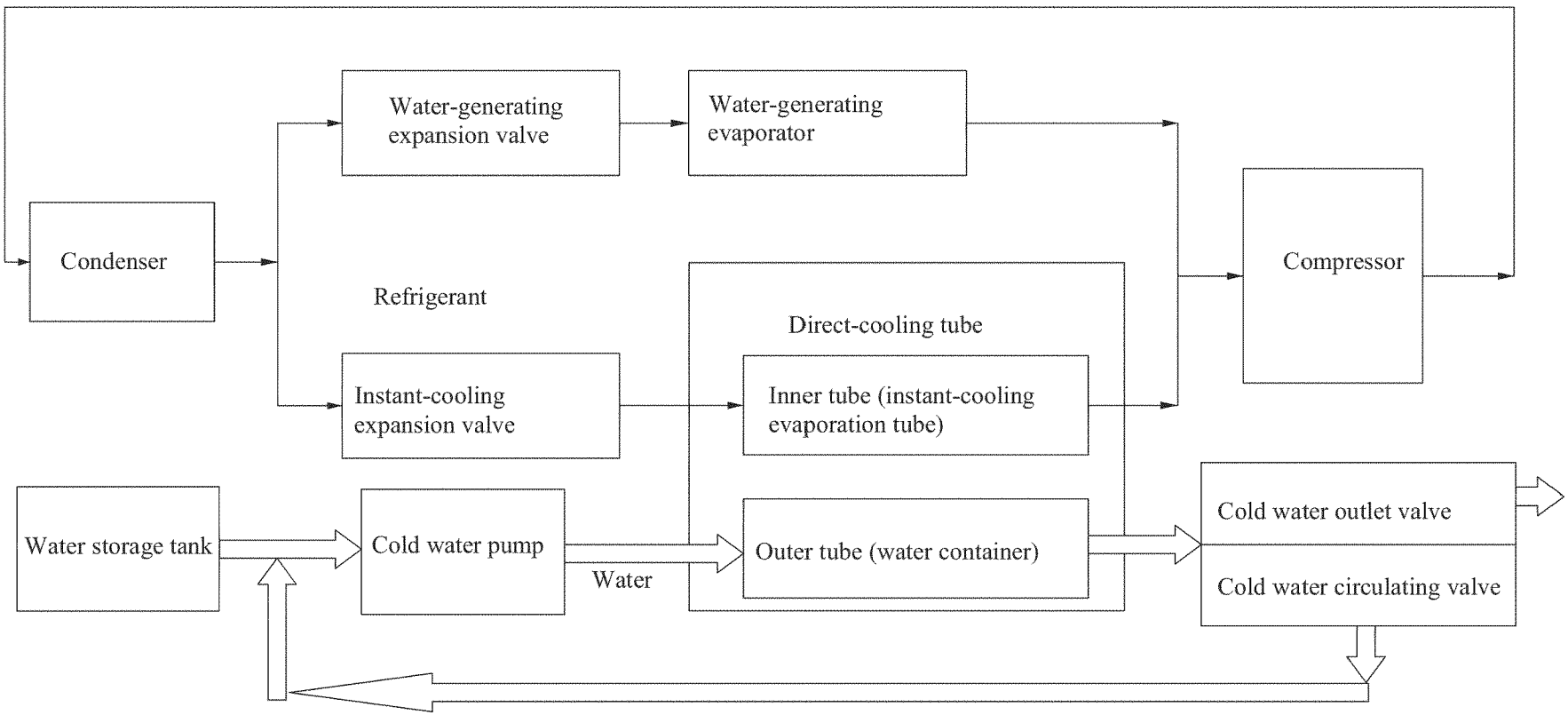
FIG. 7 is a block diagram of cold water refrigeration output and cold water circulation according to an embodiment of the present disclosure.

With reference to FIGS. 7-9, the water refrigerating device 20 further includes a water storage tank 202, a cold water pump 203, a cold water circulating valve, and a cold water outlet valve.

Specifically, the direct-cooling tube 201 is arranged between the cold water pump 203 and the cold water outlet valve, and the cold water circulating valve (see FIG. 7); that is, the outer tube 2012 of the direct-cooling tube 201 communicates with the cold water pump 203, the cold water circulating valve and the cold water outlet valve; in order to save energy, when cold water is to be output, the direct-cooling tube 201 is operated, the cold water pump 203 pumps water from the water storage tank 202 into the direct-cooling tube 201 through an outlet valve of the water storage tank, the direct-cooling tube 201 quickly reduces the temperature of the water to a desired temperature (e.g., 3-4° C.), and the cold water is output from the cold water outlet valve.

Under the action of the cold water pump, through the cold water pump 203, the direct-cooling tube 201, the cold water circulating valve, circulating flow of cold water is achieved. In the stand-by state, or in the case where no cold water is used outside, the direct-cooling tube 201 works intermittently, and the cold water is circulated back into the cold water pump 203 through the cold water circulating valve, thus ensuring that the water in the direct-cooling tube 201 remains at a temperature of 3-4° C., and the direct-cooling tube 201 does not need to work all the time, which further saves energy.

In addition, the inner tube 2011 of the direct-cooling tube 201 communicates with the condenser 102 and the compressor 103 to supply and circulate the refrigerant for cooling. That is, the refrigerant used in the inner tube 2011 of the direct-cooling tube 201 of the water refrigerating device 20 is also compressed by the compressor 103 and then delivered to the condenser 102 for cooling and then circulated into the inner tube 2011 of the direct-cooling tube 201, so that the water-generating evaporator 101 and the direct-cooling tube 201 share the same set of the compressor 103 and the condenser 102. This results in a reduction in the components of the entire atmospheric water generator, a reduction in the cost of the entire system, a reduction in energy consumption, and a compact structure, which greatly reduces the equipment volume and makes the generator more practical.

The refrigerant cooled by the condenser 102 may be delivered into the direct-cooling tube 201 through a pipeline 30 in which an expansion valve 40 may be provided. In this way, the refrigerant achieves the continuous refrigeration effect in the direct-cooling tube 201.

That is, on the pipeline output from the condenser 102, a water-generating expansion valve and an instant-cooling expansion valve are provided, and the water-generating expansion valve connects the condenser 102 and the water-generating evaporator 101; the instant-cooling expansion valve connects the refrigerant input joint 2015 of the direct-cooling tube 201 and the condenser 102. Thus, the refrigerant used in the water-generating evaporator 101 and the direct-cooling tube 201 is compressed by the compressor 103, delivered to the condenser 102 for cooling, and circulated to the water-generating expansion valve and the instant-cooling expansion valve, the water-generating expansion valve and the instant-cooling expansion valve are automatically adjusted according to the request of the water generation volume and the request of the cold water temperature, and passing through an evaporative refrigerator provided in the water-generating evaporator 101 and the direct-cooling tube 201; automatic control of the water generation volume and cold water temperature can be facilitated.

In addition, the water generation volume and temperature of the atmospheric water generator can be controlled by a control device (the control device adopts a programmable controller in the prior art).

In the description of the disclosure, it needs to be understood that, the terms "center", "longitudinal", "transverse", "length", "width", "thickness", "upper", "lower", "front", "rear", "left", "right", "vertical", "horizontal", "top", "bottom", "inner", "outer", "clockwise", "counterclockwise" and the like indicate an orientation or positional relationship based on the orientation or positional relationship shown in the drawings, only for case of description of the disclosure and for simplicity of description, it is not intended to indicate or imply that the device or element referred to must have a particular orientation, be constructed and operate in a particular orientation, and therefore should not be construed as a limitation to the disclosure.

Furthermore, the terms "first", "second" are used for descriptive purposes only, and cannot be understood to indicate or imply relative importance or to implicitly specify the number of technical features indicated. Thus, features defined by "first" and "second" may explicitly or implicitly include one or more of that feature. In the description of the present disclosure, "plurality" means two or more, unless expressly and specifically defined otherwise.

As used herein, unless expressly specified and limited otherwise, the terms "mounted", "connected", "connecting", "fixed" and the like are to be construed broadly, e.g., connection may be fixed connection or detachable connection, or integrated connection; connection may be mechanical connection or electrical connection; connection may be direct connection or indirect connection through an intermediate medium and may be in communication between two elements or in an interacting relationship between two elements. The specific meaning of the above terms in the present disclosure can be understood by those of ordinary skill in the art according to specific circumstances.

In the present disclosure, unless expressly specified and defined otherwise, a first feature being "above" or "below" a second feature may include that the first and second features are in direct contact or that the first and second features are not in direct contact but are in contact through another feature between them. Also, a first feature being "on", "above" and "over" a second feature includes that the first feature is located directly above and obliquely above the second feature, or simply indicates that the first feature is at a higher level than the second feature. A first feature being "under", "below" and "beneath" a second feature includes that the first feature is directly below and obliquely below the second feature, or simply indicates that the first feature is at a lower level than the second feature.

In the description in this specification, the description of reference terms "one embodiment", "some embodiments", "an example", "a specific example", or "some examples" or the like means that particular features, structures, materials, or characteristics described in combination with the embodiment or example are included in at least one embodiment or example of the present disclosure. In this specification, schematic representations of the above terms should not be understood as necessarily referring to the same embodiment or example. Furthermore, the particular features, structures, materials, or characteristics described may be combined in any suitable manner in one or more embodiments or examples. Furthermore, different embodiments or examples described in this specification may be joined and combined by those skilled in the art.

Although embodiments of the present disclosure have been shown and described above, it will be appreciated that the above embodiments are illustrative and not to be construed as limiting the present disclosure, and those of ordinary skill in the art may make changes, modifications, substitutions, and variations to the above embodiments within the scope of the present disclosure.

What is claimed is:

1. A water refrigerating device of an atmospheric water generator, comprising:

a direct-cooling tube;

a water storage tank;

a cold water pump;

a cold water circulating valve; and a cold water outlet valve;

wherein the direct-cooling tube is provided with an inner tube and an outer tube;

the outer tube is hollow inside, the outer tube is provided with a water input joint and a water output joint, the water input joint and the water output joint communicate with the inside of the outer tube to pass water inside the outer tube;

the inner tube is arranged within the outer tube, the inner tube is provided with a refrigerant input joint and a refrigerant output joint, the refrigerant input joint and the refrigerant output joint both communicate with the inner tube and both extend out of the outer tube, such that refrigerant flows in from the refrigerant input joint and out from the refrigerant output joint to cool the water flowing in the outer tube, an outer peripheral wall of the inner tube is provided with a cooling fin, and the cooling fin is adapted to contact the flow of water in the outer tube; and the outer tube of the direct-cooling tube communicates with the cold water pump, the cold water circulating valve and the cold water outlet valve; the cold water pump communicates with the water storage tank; when cold water needs to be output, the cold water pump pumps water of the water storage tank into the direct-cooling tube to make cold water, the cold water is then output from the cold water outlet valve; in a standby state, the direct-cooling tube is operated intermittently, and the cold water is circulated back into the cold water pump through the cold water circulating valve.

2. The water refrigerating device of the atmospheric water generator according to claim 1, wherein the cooling fin is formed in an Archimedean spiral type and wound around the outer peripheral wall of the inner tube.

3. The water refrigerating device of the atmospheric water generator according to claim 2, wherein end faces of both ends of the cooling fin in the width direction of the inner tube are close to or contact an inner peripheral wall of the outer tube.

4. The water refrigerating device of the atmospheric water generator according to claim 1, wherein the direct-cooling tube is formed of a plurality of sections of tube bodies parallel to each other, and adjacent tube bodies communicate with each other through a circuitous portion.

5. The water refrigerating device of the atmospheric water generator according to claim 1, wherein the water input joint and the water output joint are vertically disposed at an angle of 90° on the outer tube.

6. The water refrigerating device of the atmospheric water generator according to claim 1, wherein the atmospheric water generator comprises a condenser and a compressor, the inner tube of the direct-cooling tube communicates with the condenser and the compressor to supply and circulate the refrigerant for cooling.

7. The water refrigerating device of the atmospheric water generator according to claim 1, wherein the atmospheric water generator further comprises a water-generating evaporator, a water-generating expansion valve and an instant-cooling expansion valve, an output end of a condenser is connected with the water-generating expansion valve and the instant-cooling expansion valve, an input end of the condenser is connected with a compressor, the water-generating expansion valve communicates with the water-generating evaporator, the instant-cooling expansion valve communicates with the refrigerant input joint of the inner tube, and the water-generating evaporator and the refrigerant output joint of the inner tube both communicate with the compressor.

* * * * *